US009737792B2

(12) United States Patent
Jones

(10) Patent No.: US 9,737,792 B2
(45) Date of Patent: Aug. 22, 2017

(54) ROTARY CARD SHUFFLING DEVICE

(71) Applicant: Mark Hamilton Jones and Sheryl Lynn Jones Family Trust dated Nov. 7, 2013, Gardnerville, NV (US)

(72) Inventor: Mark H. Jones, Gardnerville, NV (US)

(73) Assignee: Mark Hamilton Jones and Sheryl Lynn Jones, Gardnerville, NV (US), Family Trust dated Nov. 7, 2013

( * ) Notice: Subject to any disclaimer, the term of this patent is extended or adjusted under 35 U.S.C. 154(b) by 0 days.

(21) Appl. No.: 14/609,030

(22) Filed: Jan. 29, 2015

(65) Prior Publication Data

US 2015/0209656 A1 Jul. 30, 2015

Related U.S. Application Data

(60) Provisional application No. 61/932,886, filed on Jan. 29, 2014.

(51) Int. Cl.

| | |
|---|---|
| ***A63F 1/12*** | (2006.01) |
| ***A63F 5/00*** | (2006.01) |
| *A63F 3/00* | (2006.01) |
| *A63F 5/02* | (2006.01) |
| *A63F 5/04* | (2006.01) |

(52) U.S. Cl.

CPC ..... *A63F 5/0041* (2013.01); *A63F 5/0011* (2013.01); *A63F 1/12* (2013.01); *A63F 5/0023* (2013.01); *A63F 5/0052* (2013.01); *A63F 5/02* (2013.01); *A63F 5/045* (2013.01); *A63F 2003/00274* (2013.01)

(58) Field of Classification Search

CPC .. A63F 1/12; A63F 2003/00274; A63F 5/045; A63F 5/0052; A63F 5/0023; A63F 5/0011; A63F 5/02

USPC ..... 273/142 JA, 280, 287, 142 E, 142 F, 273/142 G, 142 H, 142 HA, 142 J, 273/142 JB, 142 JC, 142 JD, 142 K, 273/149 R

See application file for complete search history.

(56) References Cited

U.S. PATENT DOCUMENTS 5,096,196 A * 3/1992 Gutknecht ..... A63F 5/0094 273/142 HA
6,659,462 B1 * 12/2003 Scott ..... A47B 25/00 273/142 HA
7,669,853 B2 * 3/2010 Jones ..... A63F 1/12 273/142 JA (Continued)

*Primary Examiner* — Benjamin Layno

(74) *Attorney, Agent, or Firm* — John S. Artz; Dickinson Wright PLLC

(57) ABSTRACT

A wheel assembly for a rotary shuffling device includes a fixed base portion with a central opening formed therein and a lower wheel assembly portion secured to the fixed base portion. The lower wheel assembly portion includes a flange portion and a sleeve portion extending from an underside of the flange portion. The sleeve portion is received within the central opening. The flange portion includes a central aperture formed therein. A bearing is disposed within the sleeve portion. An upper wheel assembly portion is in rotational communication with the lower wheel assembly portion. The upper wheel assembly portion has a top portion and a hub portion extending from an underside of the top portion. The hub portion includes an axle portion extending therefrom and through the central aperture for engagement with the bearing.

20 Claims, 8 Drawing Sheets

(56) References Cited

U.S. PATENT DOCUMENTS

| | | | | |
|---|---|---|---|---|
| 8,439,384 | B1 * | 5/2013 | Woods | A63H 5/00<br>280/288.4 |
| 2004/0116045 | A1 * | 6/2004 | Coleman | B62J 3/00<br>446/441 |
| 2006/0038343 | A1 * | 2/2006 | Adams | A63F 1/14<br>273/143 R |
| 2012/0056373 | A1 * | 3/2012 | Jones | A63F 1/00<br>273/149 R |
| 2012/0200033 | A1 * | 8/2012 | Owoc | A63F 5/046<br>273/142 JA |

* cited by examiner

ROTARY CARD SHUFFLING DEVICE

CROSS-REFERENCE TO RELATED APPLICATIONS

The present application claims priority to U.S. Provisional Patent Application Ser. No. 61/932,886, entitled "Improved Rotary Card Shuffling Device" and filed Jan. 29, 2014, the disclosure of which is hereby incorporated by reference as though set forth fully herein.

TECHNICAL FIELD

The present disclosure relates generally to an improved rotary card shuffling device for use in selecting a card for identifying a winning outcome in a game of chance. More specifically, the present disclosure relates to an improved rotary card shuffling device for use with a game of chance that provides improved accuracy and operation.

BACKGROUND OF THE INVENTION

Games of chance are well known activities whose outcomes are strongly influenced by randomizing devices and upon which contestants may wager money as they forecast outcomes. Common randomizing devices include dice, spinning tops, playing cards, roulette wheels, prize wheels, and numbered balls drawn from containers. Games of chance have been played throughout all of human history and are considered to be a popular pastime by many. Players of games of chance are attracted to new and exciting methods of game play as well as new and exciting randomizing devices. For this reason, the gaming industry is continuously developing new games and new randomizing devices to maintain player interest and attract new players.

Games of chance that include money wagers are typically regulated by governing authorities. These governing authorities enforce laws and regulations that are enacted to curtail certain kinds of games as well as certain kinds of randomizing devices. For example, in some jurisdictions, the use of dice or roulette wheels to resolve a game outcome, i.e., as the randomizing device, has been curtailed while other randomizing devices such as playing cards are permitted. Consequently, randomizing devices that use playing cards are more frequently utilized to resolve outcomes in games of chance played for money.

It is important that randomizing devices operate in a truly random manner to ensure integrity of the games with which they are used. This ensures that the odds associated with particular wagers are accurate and also helps minimize the potential for cheating. As is known, randomizing devices that involve a rotating wheel can exhibit patterns over time with a bias for certain stopping points that occur more frequently than others. This is known to result from the rotary components developing wear patterns that can cause biases for certain stopping points. This condition is undesirable and can cost casinos significant revenue each year as it changes the odds of the game and allows a player of the game to anticipate a particular outcome.

Therefore, there is a desire within the gaming industry to develop new and interesting methods of game play and randomizing devices which utilize playing cards in unique and interesting ways and have longer durability and accuracy.

SUMMARY OF THE INVENTION

It is therefore an aspect of the present disclosure to provide a card shuffling device that provides improved durability over existing card shuffling devices.

It is another aspect of the present disclosure to provide a card shuffling device that provides improved accuracy over existing card shuffling devices.

In accordance with the above and the other aspects of the present disclosure, an improved card shuffling device is provided. The card shuffling device includes a wheel assembly including a fixed base portion having a central opening formed therein. The wheel assembly includes a lower wheel assembly portion secured to the fixed base portion. The lower wheel assembly portion has a flange portion and a sleeve portion extending from an underside of the flange portion. The sleeve portion extends into and is received within the central opening formed in the based portion. The flange portion includes a central aperture formed therein. The sleeve portion includes a bearing disposed therein. The lower wheel assembly portion is in rotational communication with an upper wheel assembly portion. The upper wheel assembly portion has a top portion and a hub portion extending from an underside of the top portion. The hub portion includes an axle portion extending therefrom, which passes through the central aperture for engagement with the bearing to allow the upper wheel assembly to freely rotate with respect to the lower wheel assembly and the base portion.

A flapper mechanism for use with a rotary shuffling machine includes a base portion having a bottom portion, a side surface extending generally upward from the bottom portion and an upright channel portion. The upright channel portion receives a holder mechanism therein. The holder portion includes an upper portion and a lower portion and is configured to move between a first position and a second position. The upper portion of the holder mechanism has a flapper portion secured thereto and projecting therefrom. The holder mechanism is in communication with a lock mechanism, which is moveable between a locked position and an unlocked position. When the lock mechanism is in the locked position, the holder mechanism is disposed in the first position where the flapper portion can engage the rotary shuffling machine to slow rotation thereof. When the lock mechanism is disposed in the unlocked position, the holder mechanism is disposed in the second position where the flapper portion is disposed away from engagement with the rotary shuffling machine such that it can rotate freely.

BRIEF DESCRIPTION OF THE DRAWINGS

Other aspects of the present disclosure will be readily appreciated, as the same becomes better understood by reference to the following detailed description when considered in connection with the accompanying drawings wherein.

DETAILED DESCRIPTION OF THE INVENTION

Figure 1:
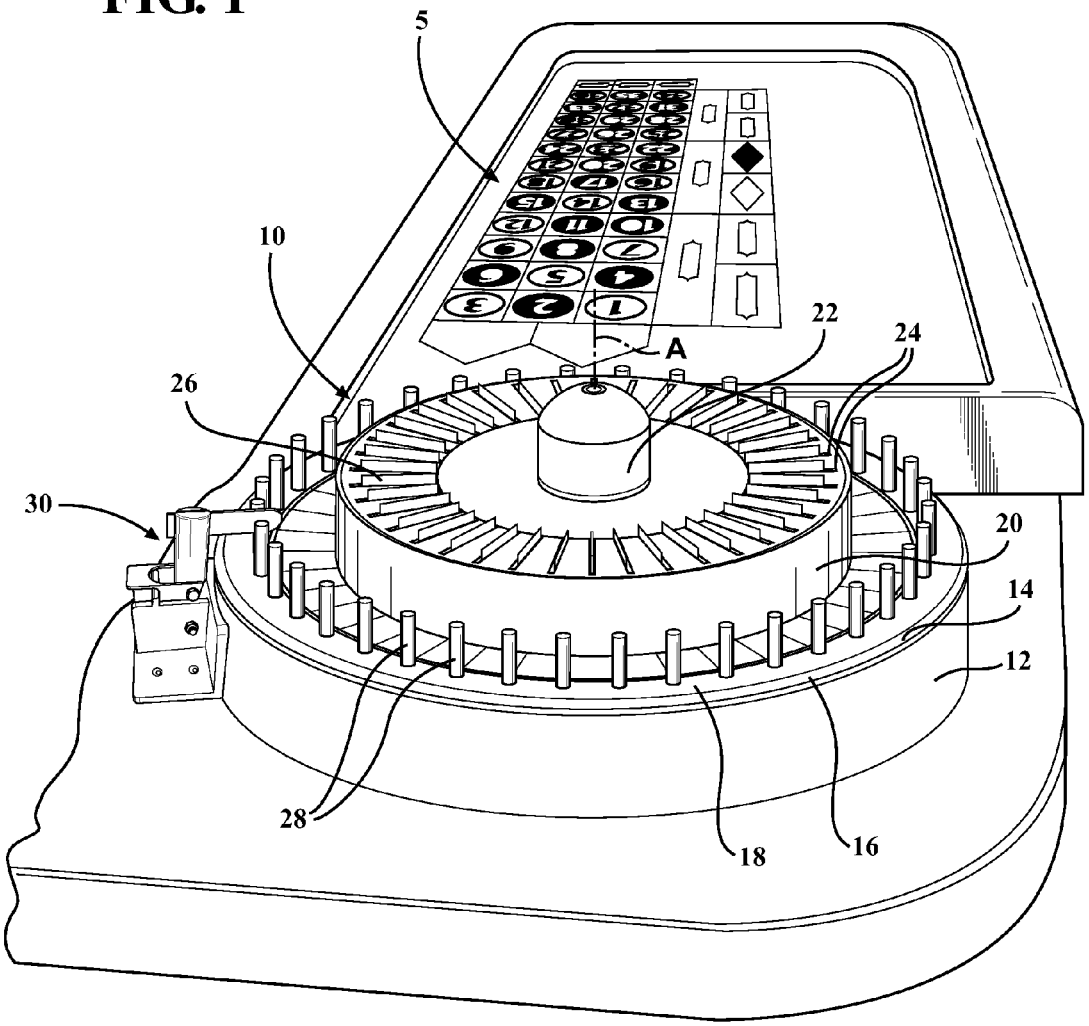
FIG. 1 is a perspective view of a table game system having a card shuffling device in accordance with an aspect of the present disclosure.

Referring to the Figures, wherein like numerals indicate like or corresponding parts throughout the several views, a card shuffling machine 10 for selecting a card from among a set of cards to determine an outcome in a game of chance generally identified by reference number 5. As perhaps best shown in FIG. 1, according to an aspect, the shuffling machine 10 can include a stationary base 12 which is effective to establish a generally vertical central axis A. Pursuant to this aspect, the base 12 is shown as a squat, generally cylindrical member, however this configuration can be varied to suit taste and application. A turntable 14 may be movably supported above the base 12 for free rotation within a generally horizontal plane about the central axis A. The turntable 14 may have a generally circular outer periphery 16, and can be configured with multiple levels forming a hat-like construction. More specifically, an outer rim section 18 may be circumscribed by the outer periphery 16 and can rest directly above the stationary base 12. An elevated stage section 20 may be centrally located therein. A decorative piece 22 may be affixed centrally within the stage section 20 for purely aesthetic purposes. It will be appreciated that the shuffling machine 10 could alternatively be secured directly to a table or other suitable structure. Additionally, the decorative piece 22 could take on a variety of different configurations or be omitted altogether.

Figure 2:
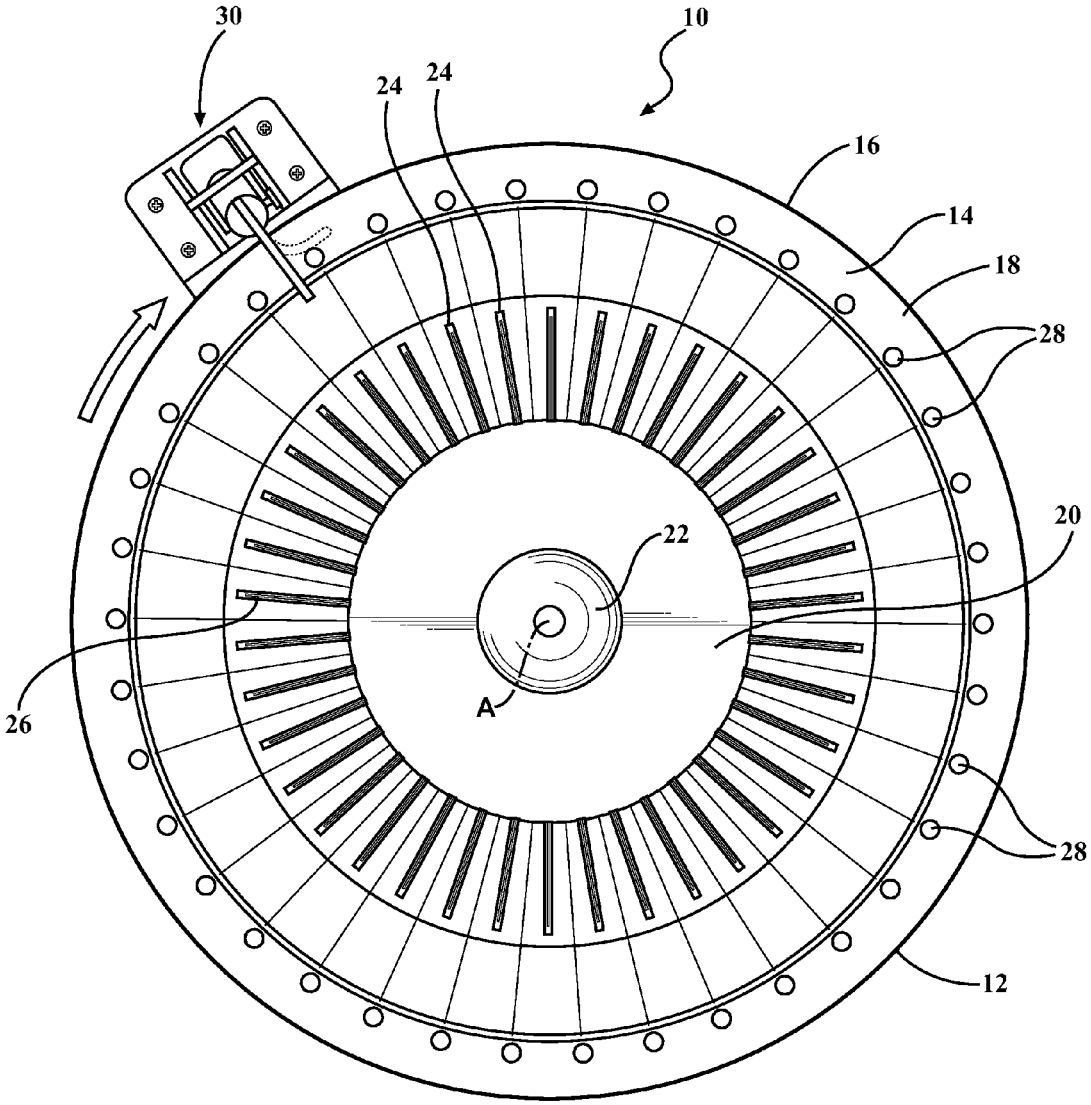
FIG. 2 is a top view of a card shuffling device in accordance with an aspect of the present disclosure.

According to an aspect, the turntable 14 can include a plurality of trays 24. As shown, the plurality of trays 24 could be disposed on the stage section 20. Alternatively, the plurality of trays 24 could be disposed in other locations such as disposed around the stage section. In the exemplary aspect depicted in FIGS. 1 and 2, the defined plurality of trays 24 consist of exactly thirty-eight trays. Depending upon the game of chance to be played, however, the defined plurality of trays 24 can be varied to include more than or less than the exemplary thirty-eight trays illustrated here. The trays 24 may be equally circumferentially spaced apart one from another about the central axis A. In other words, pursuant to the aspect where thirty-eight trays 24 are provided, each tray occupies a sector of approximately 9.47°. If the number of trays 24 were decreased to thirty-six, for example, each tray 24 would occupy a sector of exactly 10°, and so forth. The trays 24 may, as shown in the Figures, comprise narrow slots arranged along radials extending from the central axis A. Each slot may be sized, shaped and oriented so as to hold a single playing card 26 in a vertically upstanding orientation.

The card 26 may be dimensionally similar to those used for playing card games like poker, blackjack and the like. Instead of the traditional rectangular configuration, the cards 26 may be shaped in other interesting or effective geometries. A set of cards 26 may be equal in number to the defined plurality of trays 24. Thus, in keeping with the previously proposed example of thirty-eight trays 24, a set of cards would consist of thirty-eight distinct cards 26 with indicia relevant to determining an outcome of the game of chance being played. Examples of card sets are disclosed in Applicant's co-pending U.S. patent application Ser. No. 11/947,202, entitled "Card Shuffling Machine", which is hereby incorporated by reference as though set forth fully herein. The trays 24 may be arranged so as to hold each card 26 so that its long edges are oriented horizontally, and its short edges are oriented vertically. According to an aspect, the depth of each slot in the trays 24 may be less than the narrow width of each card 26, so that a noticeable, protruding portion of each card 26 extends above the stage section 20 of the turntable 14 in which the trays are recessed. This protruding portion can allow the dealer or operator of a game of chance using the card shuffling machine 10 to easily remove a card 26 from its tray 24. Thus, each card 26 may be loosely contained in its respective tray 24 without the use of fastening devices, spring clips, or any other fixation medium. Alternatively, the cards 26 could be disposed face up in designated areas on the turntable 14 so that they are visible as the turntable 14 rotates. The cards 26 could also be retained to keep them in position such as by a securing mechanism or the like.

According to an aspect, the rim section 18 of the turntable 14 may be provided with a plurality of dividers 28. The plurality of dividers 28 may be equal in number to the defined plurality of trays 24. Thus, in the exemplary embodiment where thirty-eight trays 24 are provided, the number of dividers 28 can also be thirty-eight. The dividers 28, like the trays 24, may also be spaced one from another in equal circumferentially-spaced increments about the central axis A. Thus, if the trays 24 are spaced one from another 9.47°, the dividers 28 may likewise be spaced one from another 9.47°. Accordingly, the space between each divider 28, as determined by a reference center line, occupies a sector equal to 9.47°, or whatever arcuate measure is achieved when the number 360 is divided by the number of dividers 28. Preferably, although by no means necessarily, the dividers 28 may be oriented so as to perfectly bisect the angular sector between each adjacent tray 24. Said another way, a radial extending from each divider 28 to the central axis A is preferably, but not necessarily, offset from the center-line of each adjacent tray 24 by an angular measure equal to the total number of trays 24 divided by 720. In this manner, the space or gap between each divider 28 may be exclusively associated with one specific tray 24.

A flapper mechanism 30 may be fixed relative to the base 12 and configured to operatively interact with the dividers 28, as is discussed in more detail herein. According to an aspect, the flapper mechanism 30 can function to apply a pulsating resistance to the free rotation of the turntable 14 and thereby progressively slow the turntable 14 to a stopped condition relative to the base 12.

Figure 3:
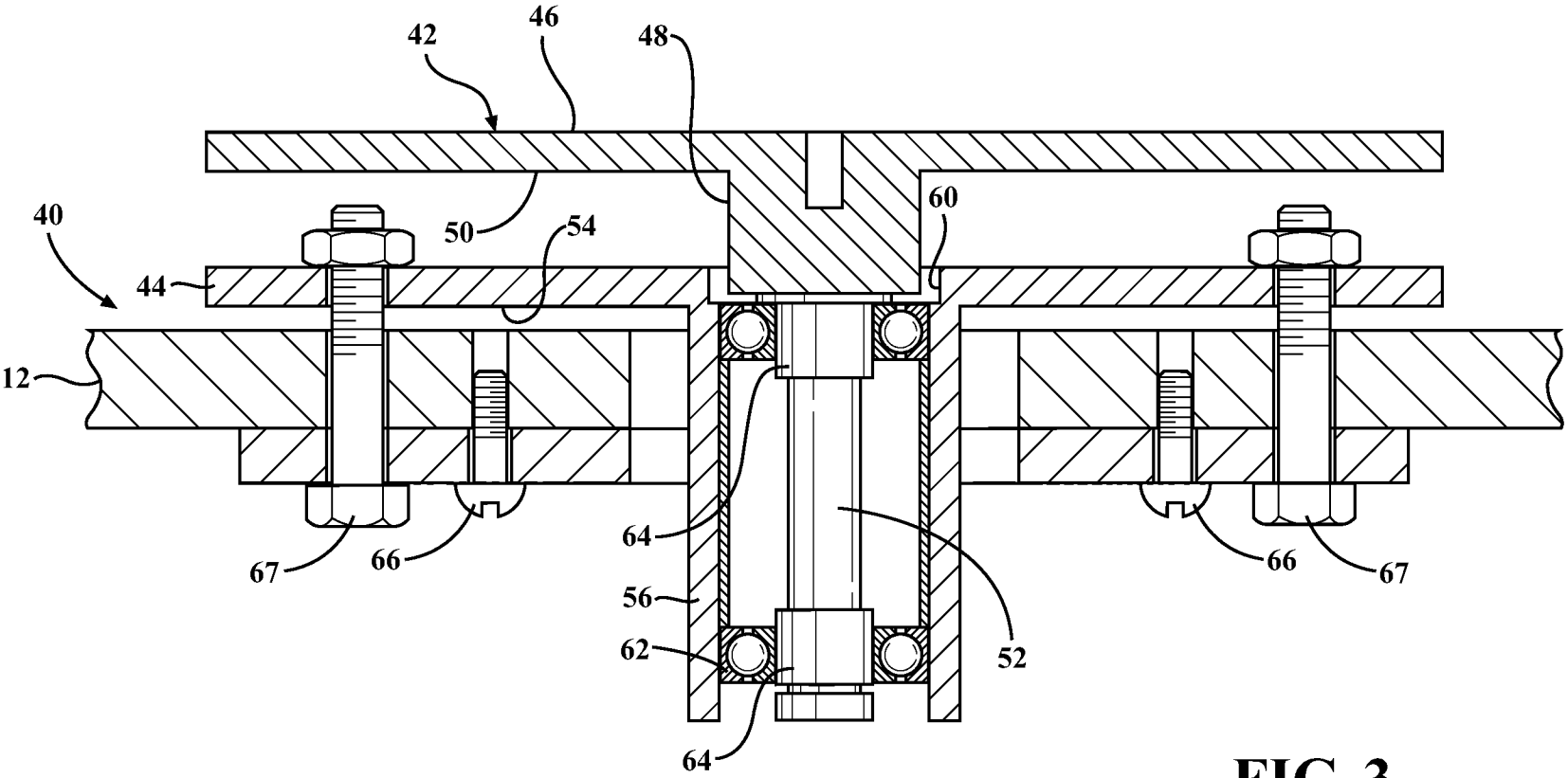
FIG. 3 is a cross-sectional view of a card shuffling device in accordance with an aspect of the disclosure.
Figure 4:
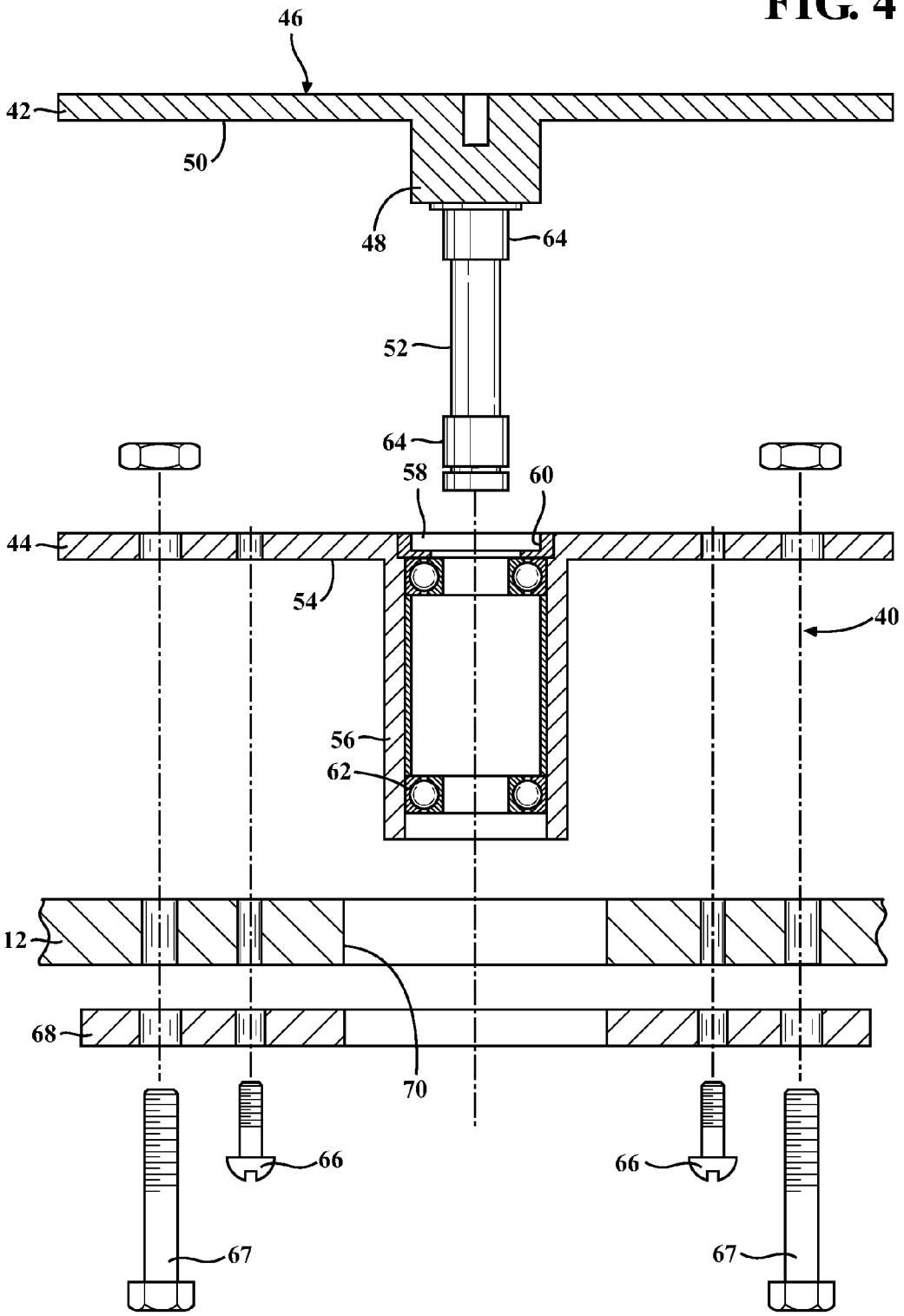
FIG. 4 is an exploded cross-sectional view of components of a wheel assembly for a card shuffling device in accordance with an aspect of the disclosure.
Figure 5:
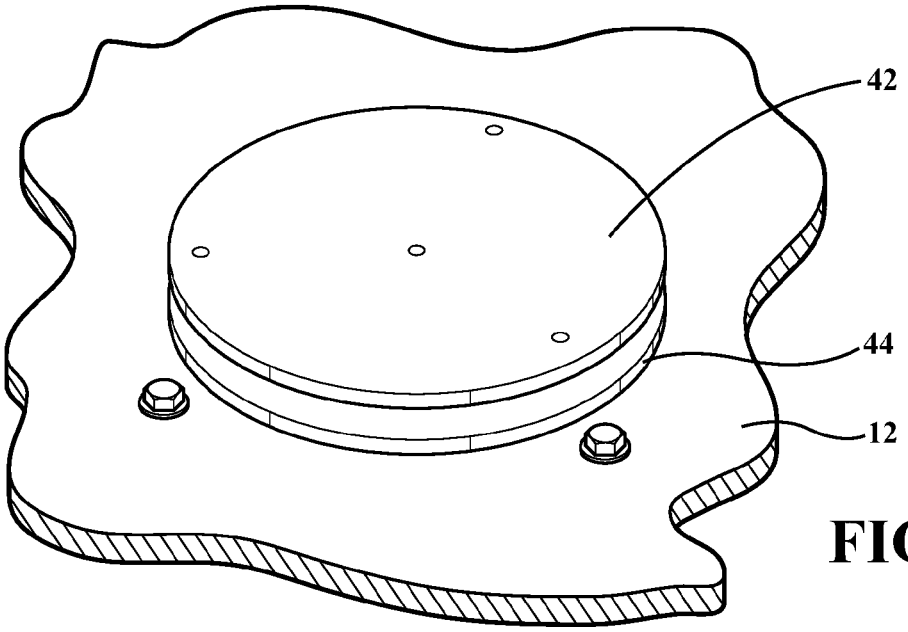
FIG. 5 is a top perspective view of a portion of a wheel assembly for a card shuffling device in accordance with an aspect of the disclosure.
Figure 6:
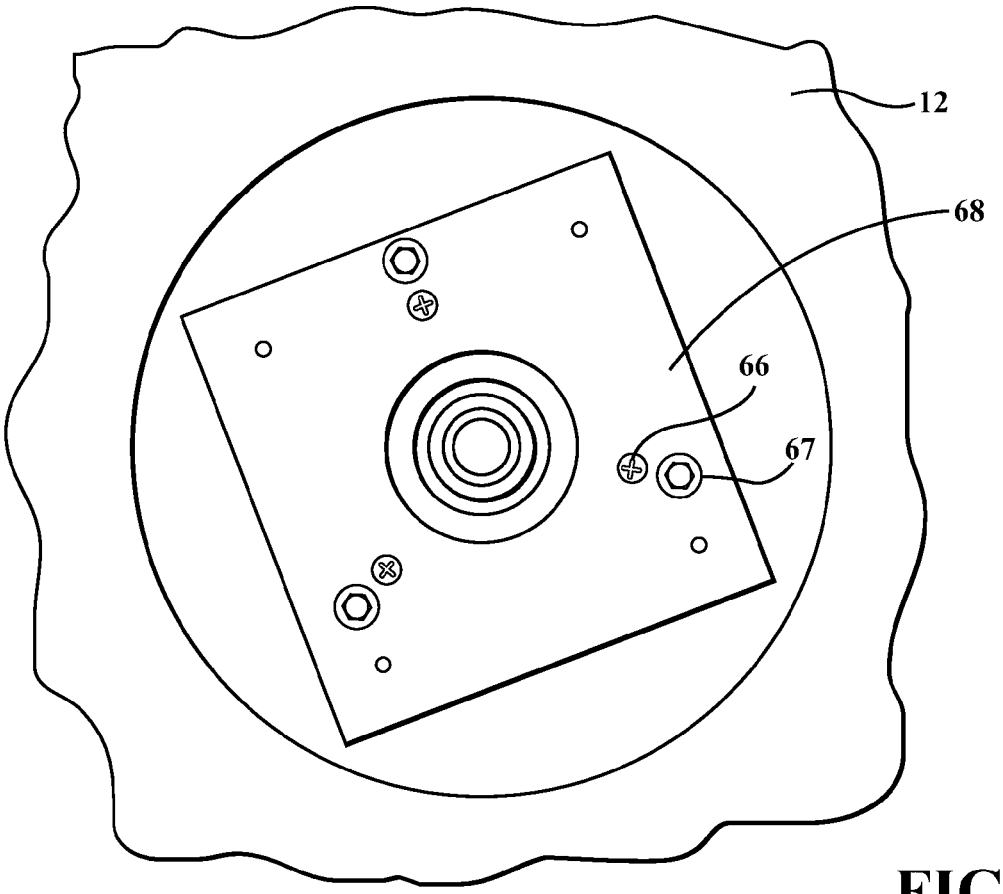
FIG. 6 is a bottom perspective view of a portion of a wheel assembly for a card shuffling device in accordance with an aspect of the disclosure.
Figure 7:
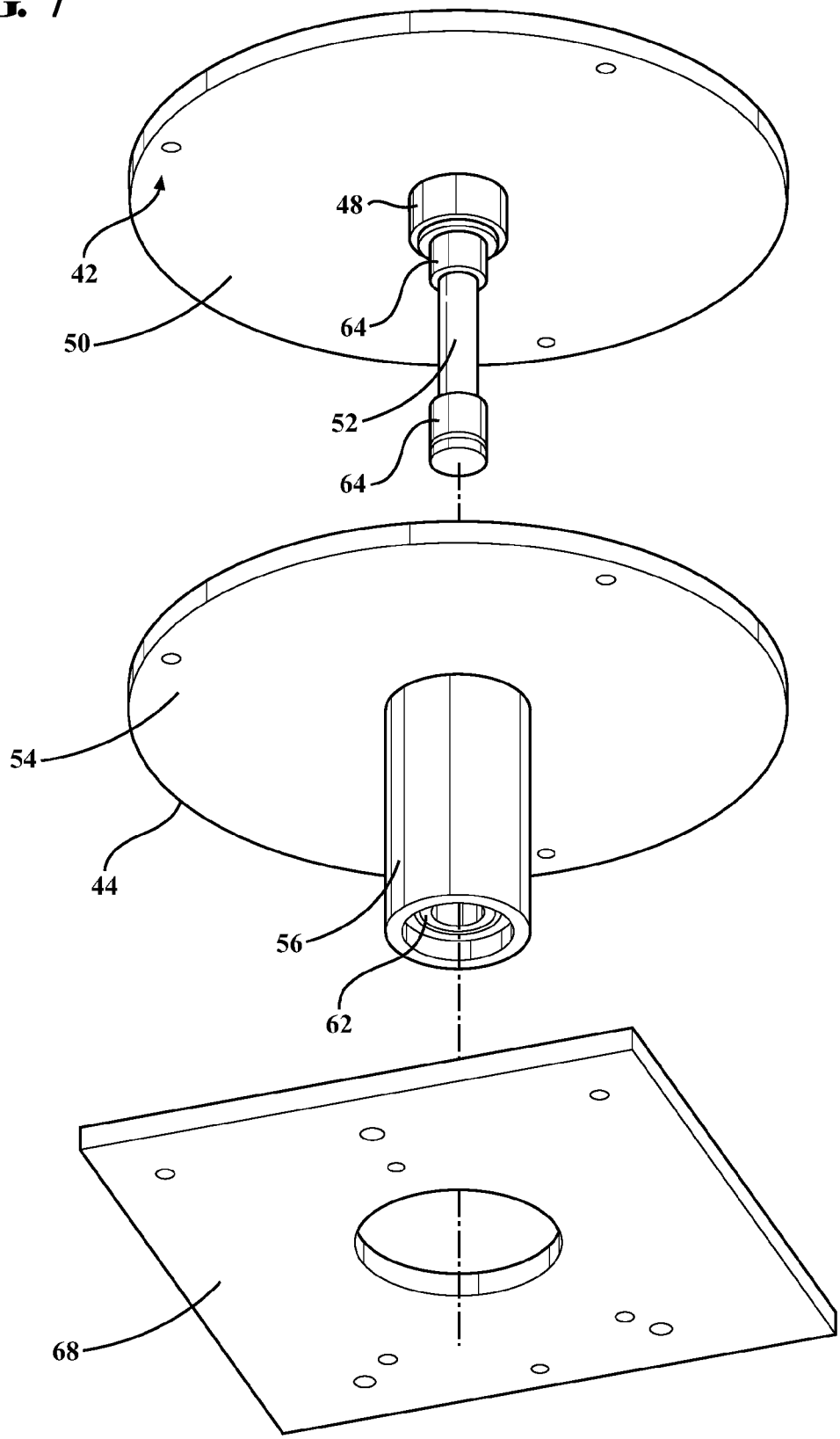
FIG. 7 is a perspective exploded view of components of a wheel assembly for a card shuffling device in accordance with an aspect of the disclosure.

Turning now to FIGS. 3 and 4, which generally illustrate the wheel assembly of the shuffling machine 10. As shown, according to an aspect, the wheel assembly 40 can include a first portion 42 and a second portion 44. The first portion 42 may include a generally circular top portion 46 with a hub portion 48 extending from an inner surface 50 thereof. According to an aspect, an axle portion 52 can generally extend from the hub portion 48. The second portion 44 may be generally t-shaped and can include a generally circular upper portion 54 and a hollow receiving portion 56. As shown, the axle portion 52 may extend through an opening 58 in the upper portion 54 of the second portion 44 and into the hollow receiving portion 56 such that the axle portion 52 is telescopically received in the hollow receiving portion 56. The hub portion 48 can rest on a shoulder portion 60 formed in the second portion 44 at a junction between the upper portion 54 and the hollow receiving portion 56. According to aspect, the hollow receiving portion 56 can include a bearing 62 which engages bearing surfaces 64 on the axle portion 52 and allows relative rotation therebetween.

With reference generally to FIGS. 3 through 6, the wheel assembly 40 may be secured to the base 12 or other suitable structure in order to finally retain it in position such that the first portion 42 may rotate with respect to a fixed structure. According to an aspect, this is accomplished by securing the second portion 44 to the base 12 by a plurality of securing mechanism 66 such as a fastener. However, any suitable securing mechanism may be employed. As shown, the hollow receiving portion 56 with received axle portion 52 may be passed through a central opening 70 in the base 12. According to an aspect, a plate portion 68 may be disposed on the underside of the base 12 and may be secured to the second portion 44 and the base 12. The plate portion 68 may be secured to the second portion 44 through the base portion 12 be the plurality of locking mechanism 67. Additional locking and securing mechanism may also be employed. The combination of the securing mechanism (e.g., screws) and the locking mechanism (e.g., bolts) allows for alignment and tolerance adjustments so as to properly attach, align and keep aligned the first portion 42, the second portion 44 and the base 12. This will help ensure that the first portion 42 and attached turntable 14 rotate freely and eliminate any potential bias for certain stopping points. According to an aspect, the securing mechanism 66 is passed through openings in each of the first portion 42, the second portion 44 and the base 12 to secure these structures. The locking mechanism 67 can then be passed through the same structures and retained in place by a nut or the like. Once the structures are fixedly attached, the securing mechanism 66 can be tightened or otherwise adjusted to properly align and attach these structures to ensure proper operation.

According to another aspect, the turntable 14 may be secured to the first portion 42 at the top portion via a plurality of openings with conventional fasteners or the like. This way the turntable 14 may be secured for rotation with respect to the base 12. As discussed above, the elevated stage section 20 and the plurality of trays 24 may be disposed on the turntable 14. According to an aspect, the plurality of trays 24 may be releasably disposed on the turntable 14 so that different cards (i.e., having different indicia) or different numbers of cards may be substituted into the machine 10. This will allow the shuffling machine 10 to be employed with a variety of different games. The turntable 14, the first portion 42, and the second portion 44 can all be constructed of a metal portion. However, they can also be constructed of a variety of other suitable materials.

Figure 9:
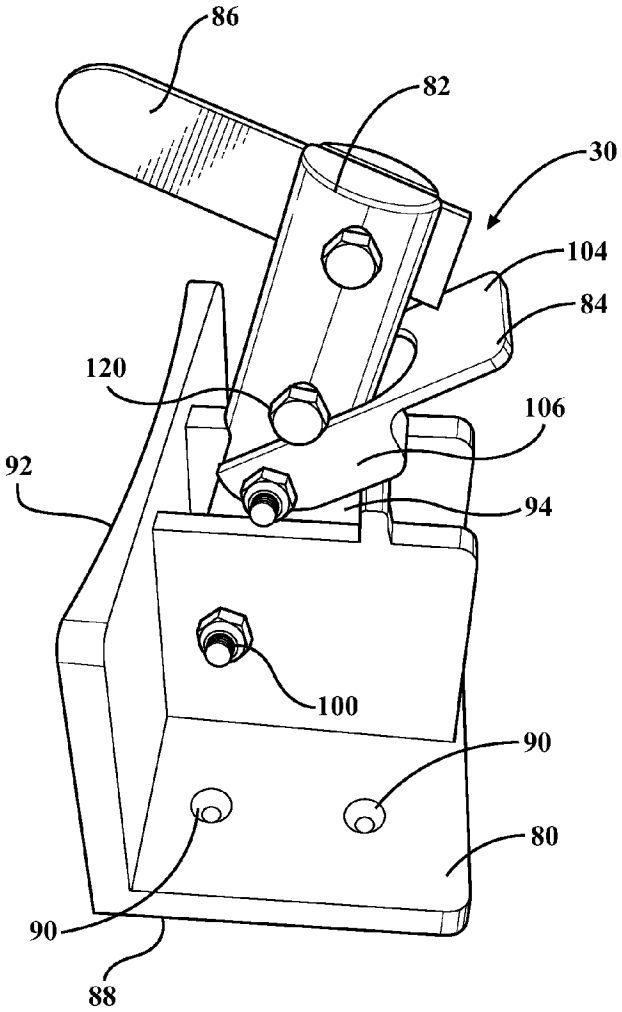
FIG. 9 is a side view of a flapper holder assembly for a card shuffling device in a unlocked position in accordance with an aspect of the disclosure.
Figure 8:
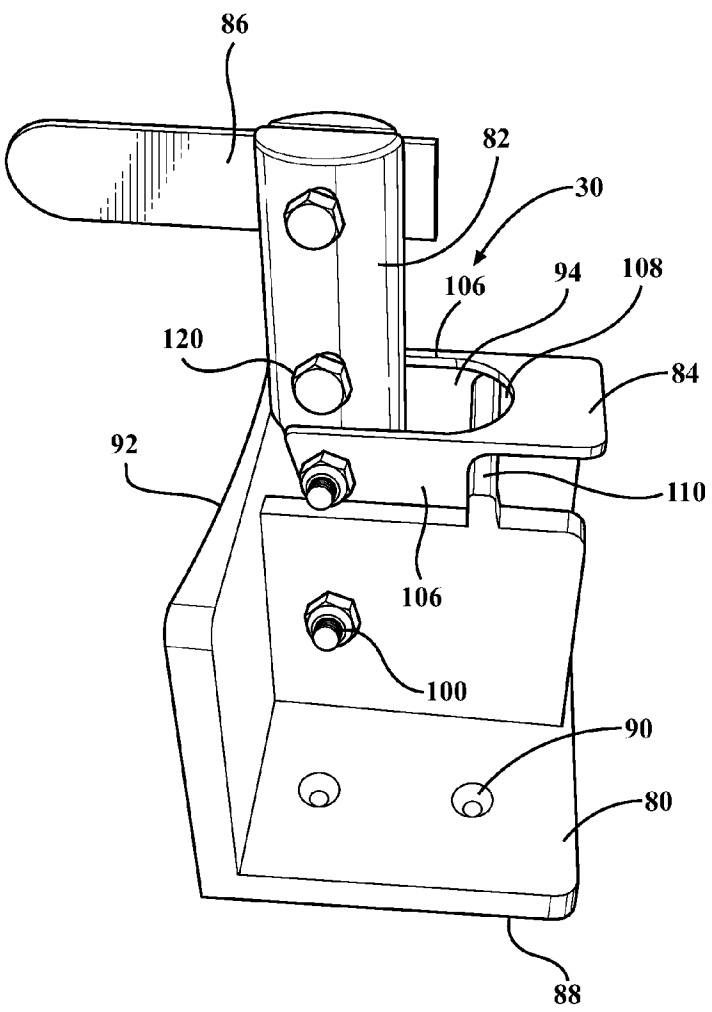
FIG. 8 is a perspective view of a flapper holder assembly for a card shuffling device in a locked position in accordance with an aspect of the disclosure.
Figure 10:
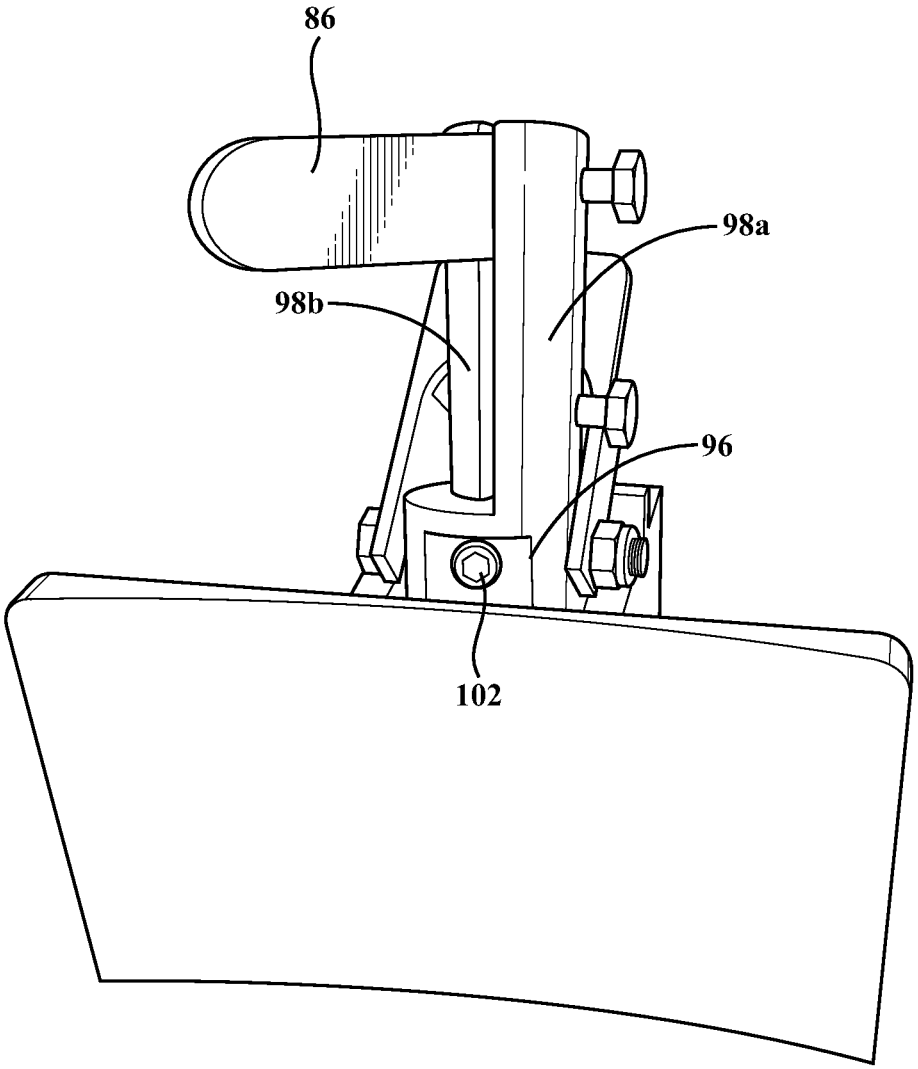
FIG. 10 is front view of a flapper holder assembly for a card shuffling device in a unlocked position in accordance with an aspect of the disclosure.

With reference to FIGS. 8 through 10, a flapper mechanism 30 in accordance with an aspect is illustrated. The flapper mechanism 30 may include a base portion 80, a holder portion 82, a lock mechanism 84 and a flapper 86. According to an aspect, the base portion 80 has a bottom surface 88 that can rest on a table or other structure. The bottom surface 88 may be permanently mounted to the table through a plurality of bolt holes 90. The base portion 80 can also include an inner surface 92 that lies adjacent the outer periphery 16 of the turntable 14. The inner surface 92 may have a concave shape such that it generally matches the shape or radium of the outer periphery of the turntable 14. The inner surface 92 may also have other suitable configurations. The base portion 80 can also include a channel 94 disposed rearward of the inner surface 92.

The holder portion 82 may be disposed in the channel 94 of the base portion 80. According to an aspect, the holder portion 82 can include a lower portion 96 and a pair of generally circular side pieces 98*a*, 98*b* that are sandwiched together. The lower portion 96 of the holder portion 82 may rest in the channel 94 and be retained therein by a bolt 100 or the like. Obviously, other suitable securing mechanism may be utilized. The side pieces 98*a*, 98*b* may be secured to one another by a plurality of screws 120 and can be tightened and loosened to vary the space between the side pieces 98*a*, 98*b*. According to an aspect, the flapper 86 may be disposed between the side pieces 98*a*, 98*b* and retained in position. According to an aspect, the flapper 86 may be configured to contact the dividers 28 as the turntable 14 rotates in a pulsating fashion to gradually slow the turntable 14. The flapper 86 may be configured to have some resilience and can be formed of a variety of suitable materials. According to another aspect, the lower portion 96 may include a set screw opening with a set screw 102 disposed therein. According to a further aspect, the set screw 102 may be employed to tighten up the components of the flapper mechanism 30 to minimize the effect of any vibrations resulting from engagement with the rotating shuffling device.

According to an aspect, the lock mechanism 84 consists of a tab portion 104 and a pair of leg portions 106 that define a half moon opening 108. The leg portions 106 may be secured to respective ones of the side pieces 98*a*, 98*b* with the side pieces 98*a*, 98*b* being located in the half moon opening 108. FIG. 8 illustrates the lock mechanism 84 in a locked position where the holder portion 82 is fixed and movement thereof is restrained. FIGS. 9 and 10 illustrate the lock mechanism 84 in an unlocked position where the holder portion 82 is angled rearward such it will not engage the turntable 14. In the locked position, the rear ends of the leg portions 106 engage a lock bar 110, which serves to lock the holder 82 and restrain movement thereof. The set screw can also be tightened to minimize vibrations of the holder 82. As will be appreciated, in the unlocked position, the turntable 14 may freely spin as the flapper 86 does not engage the dividers 28. According to an aspect, the flapper 86 can engage the dividers 28 and begin to gradually slow rotation of the turntable 14 when disposed in the locked position. According to another aspect, the lock mechanism 84 can assist in keeping the flapper 86 in place and can minimize any movement thereof that can result from contact with the dividers 28 and the vibration caused thereby. According to a further aspect, when the lock mechanism 84 is moved to the unlocked position, the pivoting of the tab portion 104 upward causes the holder portion 82 to pivot rearwardly. It will be appreciated that the holder portion 82 can be moved in a variety of other suitable ways.

As mentioned previously, each card 26 bears indicia related to a decision for a game of chance. Almost any of the known games of chance can be played using the card shuffling machine 10 of the present disclosure, so long as the number of cards 26 and the number of their represented indicia result in a probability of decision which is equivalent to the traditionally played game, such as roulette, craps, blackjack and many others as disclosed in Applicant's co-pending application Ser. No. 11/947,202, which is hereby incorporated by reference. Alternatively, other suitable games may be employed.

As will be appreciated, when spun forcefully, the angular momentum of the turntable 14 is sufficient to deflect the flapper 84 out of the way in a flipper-like fashion typical of prize wheel-type randomizing devices known in the prior art. The flapper 84 may be made of a felt-like material, or other suitable material. Each sequential impact and deflection of the flapper 84 caused by the rotating dividers 28 results in a pulsating resistance which slows the turntable 14 and eventually brings it to a complete stop. It will be appreciated that the turntable 14 may be rotated automatically upon actuation of the appropriate button. Alternatively, the turntable 14 may be operated under computer control and be rotated automatically. It will also be appreciated that the turntable 14 could also be stopped automatically with or without the aid of the flapper 84.

The card shuffling machine 10 may also include some type of pointing device, which is fixed relative to the base 12, for indicating one of the plurality of trays 24 when the turntable 14 comes to rest. According to one aspect, the pointer may be integral with the flapper mechanism 30, in that the tray 24 residing between the dividers 28 on opposite sides of the flapper 84, when the turntable 14 comes to rest, will determine which card 26 has been selected for the purpose of determining game outcome. Although, a separate and distinct pointer may be used, spaced from the flapper mechanism 30, to indicate one of the plurality of trays 24 when the turntable 14 stops rotating.

Note that not all of the activities described above in the general description or the examples are required, that a portion of a specific activity may not be required, and that one or more further activities may be performed in addition to those described. Still further, the orders in which activities are listed are not necessarily the order in which they are performed.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Many other embodiments may be apparent to those of skill in the art upon reviewing the disclosure. Other embodiments may be used and derived from the disclosure, such that a structural substitution, logical substitution, or another change may be made without departing from the scope of the disclosure. Accordingly, the disclosure is to be regarded as illustrative rather than restrictive.

Certain features are, for clarity, described herein in the context of separate embodiments, may also be provided in combination in a single embodiment. Conversely, various features that are, for brevity, described in the context of a single embodiment, may also be provided separately or in any sub combination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The invention claimed is:

1. A rotary shuffling device used in connection with a game of chance, comprising:

a fixed base portion having a central opening formed therein;

a first wheel assembly portion secured against relative rotation to the fixed base portion, the first wheel assembly portion having a flange portion and a sleeve portion extending from an underside of the flange portion, the sleeve portion being received within the central opening;

a central aperture formed in the flange portion;

a bearing structure disposed within the sleeve portion;

a second wheel assembly portion in rotational communication with the first wheel assembly portion, the second wheel assembly portion having a top portion and a hub portion extending from an underside of the top portion; and an axle portion extending from the hub portion which passes through the central aperture for engagement with the bearing structure;

whereby the second wheel assembly may freely rotate with respect to the first wheel assembly and the base portion.

2. The device of claim 1, wherein the flange portion is generally circular in shape and has a generally flat upper surface.

3. The device of claim 1, wherein the sleeve portion is generally cylindrical in shape.

4. The device of claim 1, wherein the flange portion of the first wheel assembly includes a shoulder portion formed around a periphery of the central aperture;

wherein the hub portion engages the shoulder portion.

5. The device of claim 1, wherein the base portion includes a recess formed an underside thereof, and further including a plate portion disposed in the recess and operably secured to the first wheel assembly portion by a plurality of locking mechanisms such that the base portion is sandwiched between the plate portion and the first wheel assembly portion.

6. The device of claim 5, wherein the plate portion includes a hole for receiving the sleeve portion.

7. The device of claim 1, wherein the top portion has a generally circular shape.

8. The device of claim 1, further including a turntable portion fixed for co-rotation to said second wheel assembly portion, said turntable portion having a plurality of slots uniformly spaced therearound, whereby each of the slots is configured to receive a card from a set of cards.

9. A rotary shuffling device for use in connection with a game of chance, comprising:

a fixed base portion having a central opening formed therein and a recess formed in an underside thereof;

a lower wheel assembly portion secured to the fixed base portion, the lower wheel assembly portion having a flange portion and a sleeve portion extending from an underside of the flange portion, the sleeve portion being received within the central opening;

a central aperture formed in the flange portion;

a bearing disposed within the sleeve portion;

an upper wheel assembly portion in rotational communication with the lower wheel assembly portion, the upper wheel assembly portion having a top portion and a hub portion extending from an underside of the top portion; and an axle portion extending from the hub portion through the central aperture for engagement with the bearing;

a plate portion disposed in the recess and secured to the lower wheel assembly portion by a plurality of securing mechanism that engage the lower wheel assembly, the base portion and the plate portion; and a turntable portion having a plurality of slots uniformly spaced therearound, whereby each of the slots is configured to receive a card from a set of cards.

10. The device of claim 9, further including a flapper mechanism disposed adjacent the fixed base portion, comprising:

a base portion having a bottom portion, a side surface extending generally upward from the bottom portion and an upright channel portion;

a holder mechanism disposed in the upright channel portion and including an upper portion and a lower portion, the holder mechanism being configured to move between a first position and a second position;

a flapper portion secured to and projecting from the upper portion of the holder mechanism;

a lock mechanism in communication with the holder mechanism, the lock mechanism being moveable between a locked position and an unlocked position;

whereby when the lock mechanism is disposed in the locked position, the holder mechanism is in the first position such that the flapper portion can engage the upper wheel assembly to slow rotation thereof;

whereby when the lock mechanism is disposed in the unlocked position, the holder mechanism is in the second position such that the flapper portion is disposed away from engagement with the upper wheel assembly such that it can rotate freely.

11. The device of claim 10, wherein the side surface includes an outer surface that has a generally concave shape.

12. The device of claim 11, wherein the fixed base portion has a radius of curvature and the generally concave shape of the outer surface has a radius of curvature that generally matches the radius of curvature of the fixed base portion.

13. The device of claim 10, wherein the lock mechanism has a generally u-shape with a tab portion and a pair of side leg portions.

14. The device of claim 13, wherein each of the pair of side leg portions is rotatably connected to the holder portion.

15. The device of claim 10, wherein the holder portion includes a pair of substantially identical side portions that are secured to each other.

16. The device of claim 15, wherein the flapper portion is sandwiched between the side portions.

17. The device of claim 10, whereby in the second position, the lock mechanism is angled rearwardly.

18. The device of claim 17, whereby in the first position, the holder portion is oriented generally vertically.

19. The device of claim 10, further comprising:

a set screw disposed in a front face thereof to effectuate tightening of the holder mechanism.

20. A rotary shuffling device used in connection with a game of chance, comprising:

a fixed base portion having a central opening formed therein;

a first wheel assembly portion secured to the fixed base portion, the first wheel assembly portion having a flange portion and a sleeve portion extending from an underside of the flange portion, the sleeve portion being received within the central opening;

a central aperture formed in the flange portion;

a bearing structure disposed within the sleeve portion;

a second wheel assembly portion in rotational communication with the first wheel assembly portion, the second wheel assembly portion having a top portion and a hub portion extending from an underside of the top portion;

an axle portion extending from the hub portion which passes through the central aperture for engagement with the bearing structure;

whereby the second wheel assembly may freely rotate with respect to the first wheel assembly and the base portion;

a flapper mechanism disposed adjacent the fixed base portion, comprising:

a base portion having an upright channel portion;

a holder mechanism disposed in the upright channel portion and including an upper portion and a lower portion, the holder mechanism being configured to move between a first position and a second position;

a flapper portion secured to and projecting from the upper portion of the holder mechanism; and a lock mechanism in communication with the holder mechanism, the lock mechanism being moveable between a locked position and an unlocked position;

whereby when the lock mechanism is disposed in the locked position, the holder mechanism is in the first position such that the flapper portion can engage the second wheel assembly to slow rotation thereof;

whereby when the lock mechanism is disposed in the unlocked position, the holder mechanism is in the second position such that the flapper portion is disposed away from engagement with the second wheel assembly such that it can rotate freely.

* * * * *